US011742571B2

(12) United States Patent
Crowley et al.

(10) Patent No.: US 11,742,571 B2
(45) Date of Patent: Aug. 29, 2023

(54) RADIO FREQUENCY ANTENNA ASSEMBLY

(71) Applicant: RF VENUE, INC., Ashland, MA (US)

(72) Inventors: Robert J. Crowley, Sudbury, MA (US); Caleb W. Morrison, Canton, MA (US); Charles Fendrock, Sudbury, MA (US)

(73) Assignee: RF VENUE, INC., Walpole, MA (US)

( * ) Notice: Subject to any disclaimer, the term of this patent is extended or adjusted under 35 U.S.C. 154(b) by 24 days.

(21) Appl. No.: 17/542,909

(22) Filed: Dec. 6, 2021

(65) Prior Publication Data

US 2022/0181776 A1 Jun. 9, 2022

Related U.S. Application Data

(60) Provisional application No. 63/122,132, filed on Dec. 7, 2020.

(51) Int. Cl.

| | |
|---|---|
| ***H01Q 1/52*** | (2006.01) |
| ***H01Q 1/44*** | (2006.01) |
| ***H01Q 1/38*** | (2006.01) |
| ***H01Q 1/12*** | (2006.01) |

(52) U.S. Cl.

CPC ..... *H01Q 1/526* (2013.01); *H01Q 1/1214* (2013.01); *H01Q 1/38* (2013.01); *H01Q 1/44* (2013.01)

(58) Field of Classification Search

CPC ..... H01Q 1/526; H01Q 1/1214; H01Q 1/38; H01Q 1/44; H01Q 1/36; H01Q 1/42; H01Q 9/42; H01Q 21/29; H01Q 7/00; H01Q 25/005

See application file for complete search history.

(56) References Cited

U.S. PATENT DOCUMENTS

2008/0191961 A1* 8/2008 Tuttle ..... H01Q 21/28 343/893

FOREIGN PATENT DOCUMENTS

FR 2839392 A1 * 11/2003 ..... G06K 19/07749
WO WO-2018075470 A1 * 4/2018 ..... B65D 79/02

* cited by examiner

*Primary Examiner* — Hoang V Nguyen
(74) *Attorney, Agent, or Firm* — Kriegsman & Kriegsman

(57) ABSTRACT

A radio frequency (RF) antenna assembly is mounted on a shielded panel to facilitate the transmission of RF signals therethrough. The RF antenna assembly includes an RF antenna formed from wire which is bent to define first and second antenna elements. The RF antenna is inserted through the panel with the first and second antenna elements disposed on opposite sides thereof. A dome-shaped cap constructed of a compressible elastomeric material is mounted over the first antenna element and lies flush against the outer surface of the panel. A disc-shaped dielectric base receives the distal end of the second antenna element and lies flush against the inner surface of the panel. The RF antenna exerts a spring-like force that resiliently draws the cap and base together. In use, each antenna element transmits RF signals within a designated frequency range to wireless electronic devices located on the same side of the panel.

13 Claims, 10 Drawing Sheets

RADIO FREQUENCY ANTENNA ASSEMBLY

CROSS-REFERENCE TO RELATED APPLICATIONS

The present application claims the benefit under 35 U.S.C. 119(e) to U.S. Provisional Patent Application No. 63/122,132, which was filed on Dec. 7, 2020, in the names of Robert J. Crowley et al., the disclosure of which is incorporated herein by reference.

FIELD OF THE INVENTION

The present invention relates generally to radio frequency (RF) antennas and, more particularly, to RF antennas designed to transmit and receive RF signals within RF attenuated environments.

BACKGROUND OF THE INVENTION

In the modern world, electronic devices are utilized to perform a wide array of tasks across an increasing number of settings. For instance, in a smart home, various electronic devices are designed to automatically monitor and/or control certain home attributes, such as lighting, security, temperature, and entertainment. Internet of Things (IoT) devices, such as smart home appliances, remotes, printers, and the like, have become prevalent in such environments and perform a wide array of different functions.

Electronic devices, such as IoT devices, typically need to be able to communicate with other electronic devices in such environments. As a result, electronic devices are often equipped with at least one communication port, which allows for the transmission of data through a hardwired communication path, such as an ethernet cable or RF coaxial cable. To promote an expansion of potential applications, electronic devices are also commonly equipped with a radio frequency (RF) antenna to allow for the wireless transmission and reception of RF communication signals.

The growing number of wireless electronic devices within a relatively confined area can introduce electromagnetic interference, which can compromise the functionality of certain devices. As a result, a selection of electronic devices is often commonly housed within an enclosure manufactured of a material with electromagnetic Interference (EFI) and radio frequency interference (RFI) shielding characteristics to minimize the effects of interference amongst multiple wireless devices communicating within the same environment.

Electronic devices housed within an EFI/RFI-shielded enclosure typically rely upon a wired connection for data transmission, since wireless signals are largely incapable of transmission therethrough. However, since most electronic devices are equipped with a limited number of ports, reliance upon a hardwired connection often limits the scope of use for the device. Furthermore, it should be noted that certain electronic devices are only designed for wireless communication and therefore are generally precluded from being housed within such an enclosure.

SUMMARY OF THE INVENTION

It is an object of the present invention to provide a novel radio frequency (RF) antenna.

It is another object of the present invention to provide an RF antenna which is designed to transmit and receive RF signals within RF attenuated environments.

It is yet another object of the present invention to provide an RF antenna as described above which is designed to efficiently transmit and receive RF signals through a panel of a shielded enclosure.

It is still another object of the present invention to provide an RF antenna as described above which is reliable and has a low profile.

It is yet still another object of the present invention to provide an RF antenna as described above which has a limited number of parts, is inexpensive to manufacture, and is easy to use.

Accordingly, as one feature of the present invention, there is provided a radio frequency (RF) antenna assembly adapted to be mounted on a shielded panel, the shielded panel having a first surface and a second surface, the shielded panel being shaped to define a thru-hole, the RF antenna assembly comprising (a) an RF antenna comprising (i) a first antenna element tuned to transmit and receive electromagnetic signals within a first frequency range in the RF spectrum, (ii) a second antenna element tuned to transmit and receive electromagnetic signals within a second frequency range in the RF spectrum, and (iii) an intermediate segment connecting the first and second antenna elements in series, (b) a cap mounted over the first antenna element, and (c) a base mounted on the RF antenna, the base being configured to receive at least a portion of the second antenna element, (d) wherein the RF antenna assembly is adapted to be mounted on the shielded panel with the first and second antenna elements disposed on opposite surfaces of the shielded panel.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings, wherein like reference numerals represent like parts.

DETAILED DESCRIPTION OF THE INVENTION

Radio Frequency (RF) Antenna System 11

Figure 1:
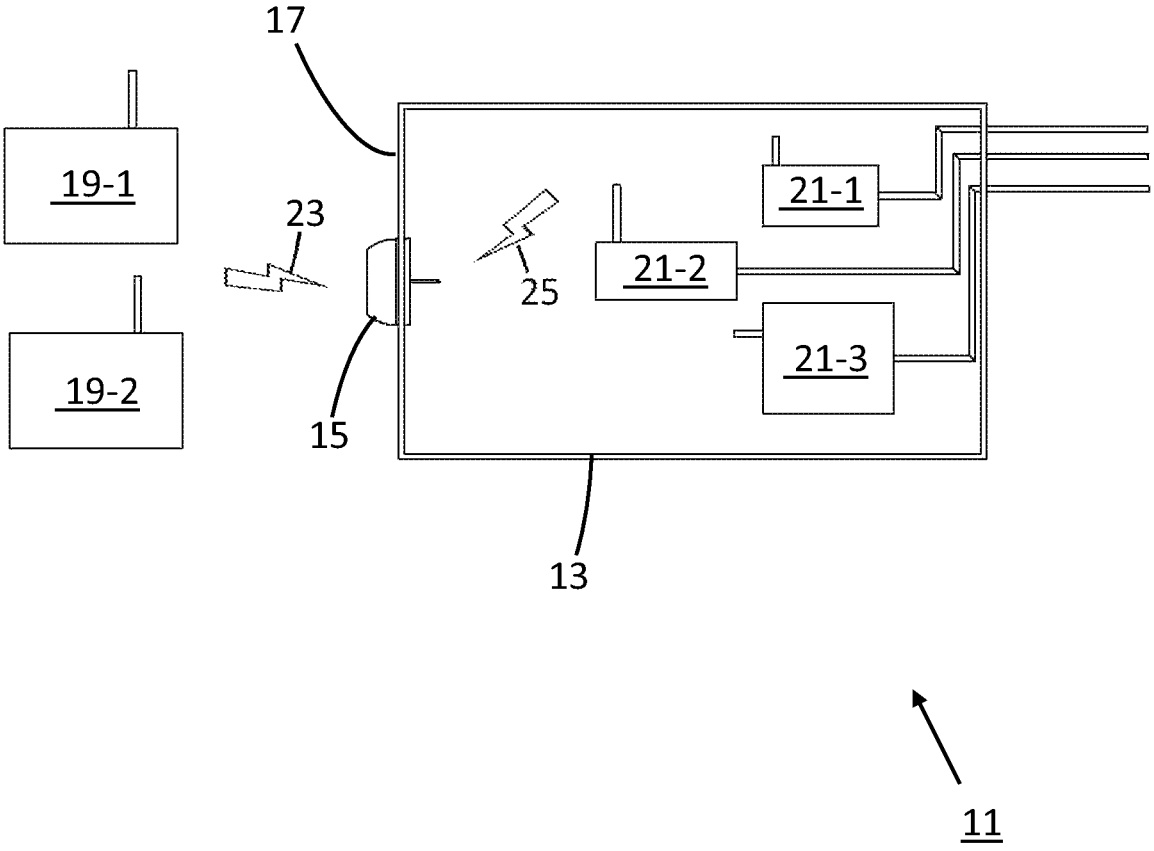
FIG. 1 is a simplified schematic view of a radio frequency (RF) antenna system constructed according to the teachings of the present invention.

Referring now to FIG. 1, there is shown a radio frequency (RF) antenna system constructed according to the teachings of the present invention, the RF antenna system being defined generally by reference numeral 11. As will be explained in detail below, RF antenna system 11 is uniquely designed to assist in the transmission and receipt of RF signals within an RF attenuated environment.

As can be seen, RF antenna 11 comprises (i) an RF-shielded enclosure, or cabinet, 13, (ii) a radio frequency (RF) antenna assembly 15 mounted on a panel 17 of enclosure 13, (iii) a first set of electronic devices with RF communication capabilities 19-1 and 19-2 located outside of enclosure 13, and (iv) a second set of electronic devices with RF communication capabilities 21-1 thru 21-3 located within enclosure 13. In use, antenna assembly 15 facilitates the transmission of RF signals between exterior devices 19 and interior devices 21. As will be described further below, antenna assembly 15 includes an exterior antenna element for establishing an RF communication path 23 with devices 19 and an interior antenna element for establishing an RF communication path 25 with devices 21. In this manner, antenna assembly 15 enables RF signals to effectively travel through panel 17 of shielded enclosure 13 with limited attenuation.

Figure 2A:
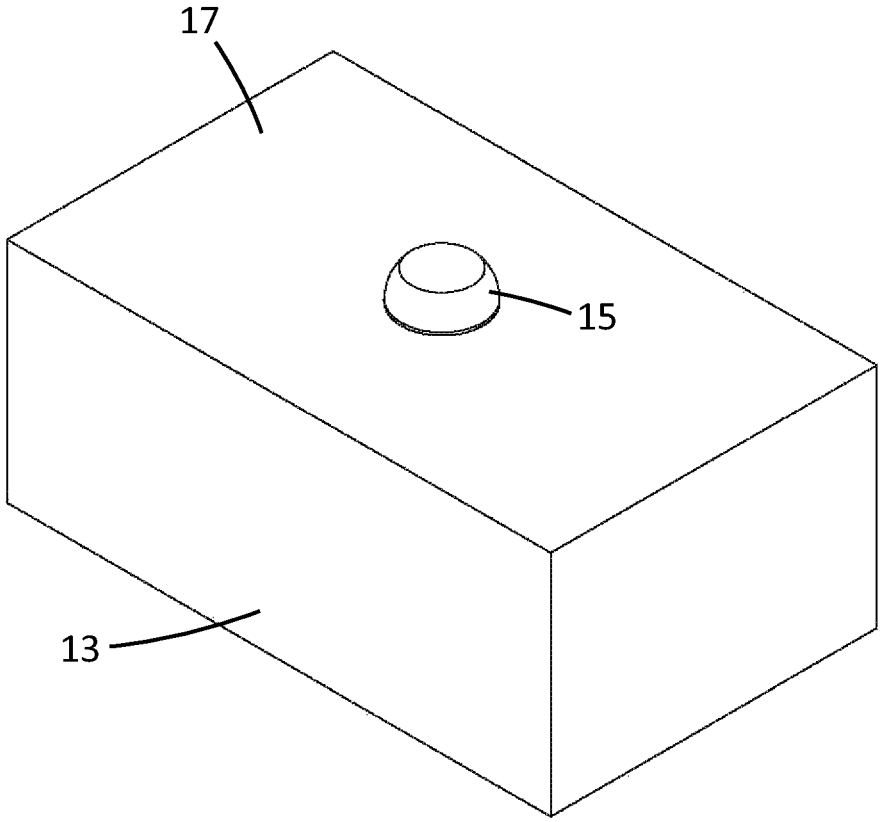
FIGS. 2(*a*) and 2(*b*) are front perspective and front plan views, respectively, of the shielded enclosure and antenna assembly shown in FIG. 1.
Figure 2B:
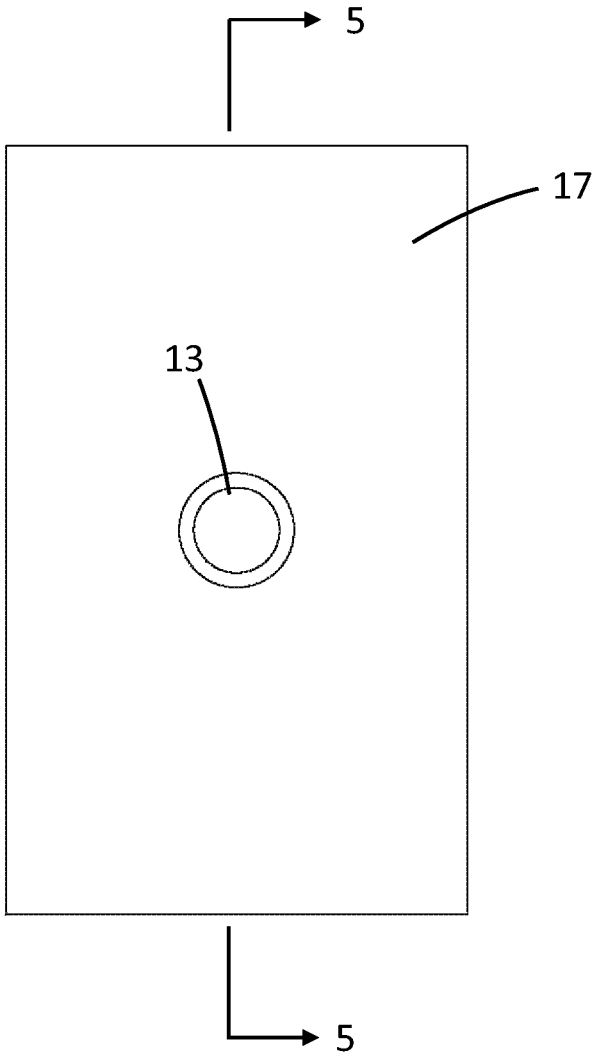

As shown in FIGS. 1, 2(*a*), and 2(*b*), shielded enclosure 13 is represented as a substantially enclosed cabinet, or box, which is configured to retain one or more electronic devices 21, such as a National Electrical Manufacturer Association (NEMA) rated electrical enclosure. Shielded enclosure 13 is preferably constructed of a metal material, such as aluminum or steel, which provides RFI/EMI-shielding properties in order to minimize signal interference within a particular setting. However, as defined herein, panel 17 represents any surface (e.g., a wall) that significantly attenuates, or blocks, RF signals passing therethrough.

Each device 19 represents any type of electronic device which is able to transmit and/or receive RF signals. Similarly, each device 21 represents any type of electronic device which is able to transmit and/or receive RF signals. For instance, each device 21 may be in the form of an Internet of Things (IoT) device which sends and/or receives data through an RF communication path. Additionally, as shown herein, each device 21 may be configured to communicate through a hardwire, or wired, communication path established through a corresponding port in enclosure 13.

As will be described in detail below, the unique construction of panel-mount antenna assembly 15 serves as the principal novel feature of the present invention. Most notably, panel-mount antenna assembly 15 is uniquely designed to efficiently transmit RF signals of a user-selected frequency band through an RF attenuated surface, while maintaining a small and compact form factor, a simple and inexpensive assembly, and a waterproof construction.

Panel-Mount Antenna Assembly 15

Figure 3:
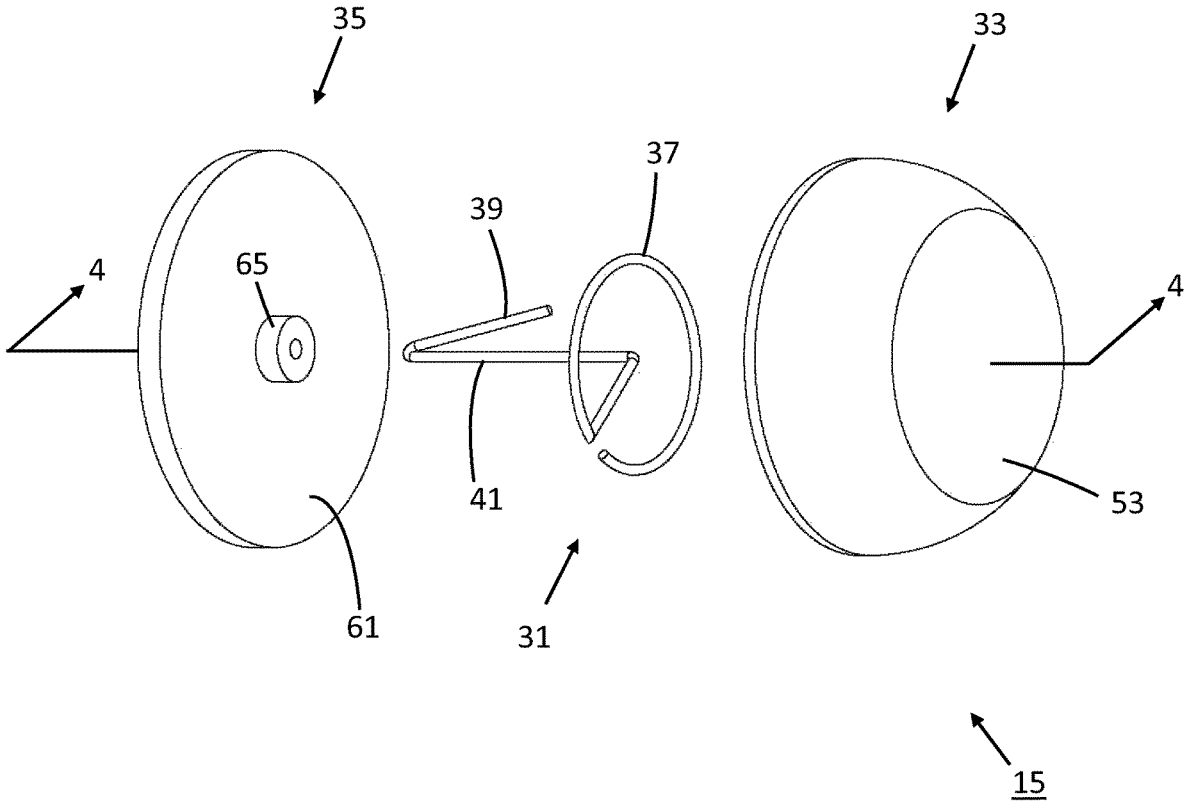
FIG. 3 is an exploded, front perspective view of the antenna assembly shown in FIG. 1.
Figure 4:
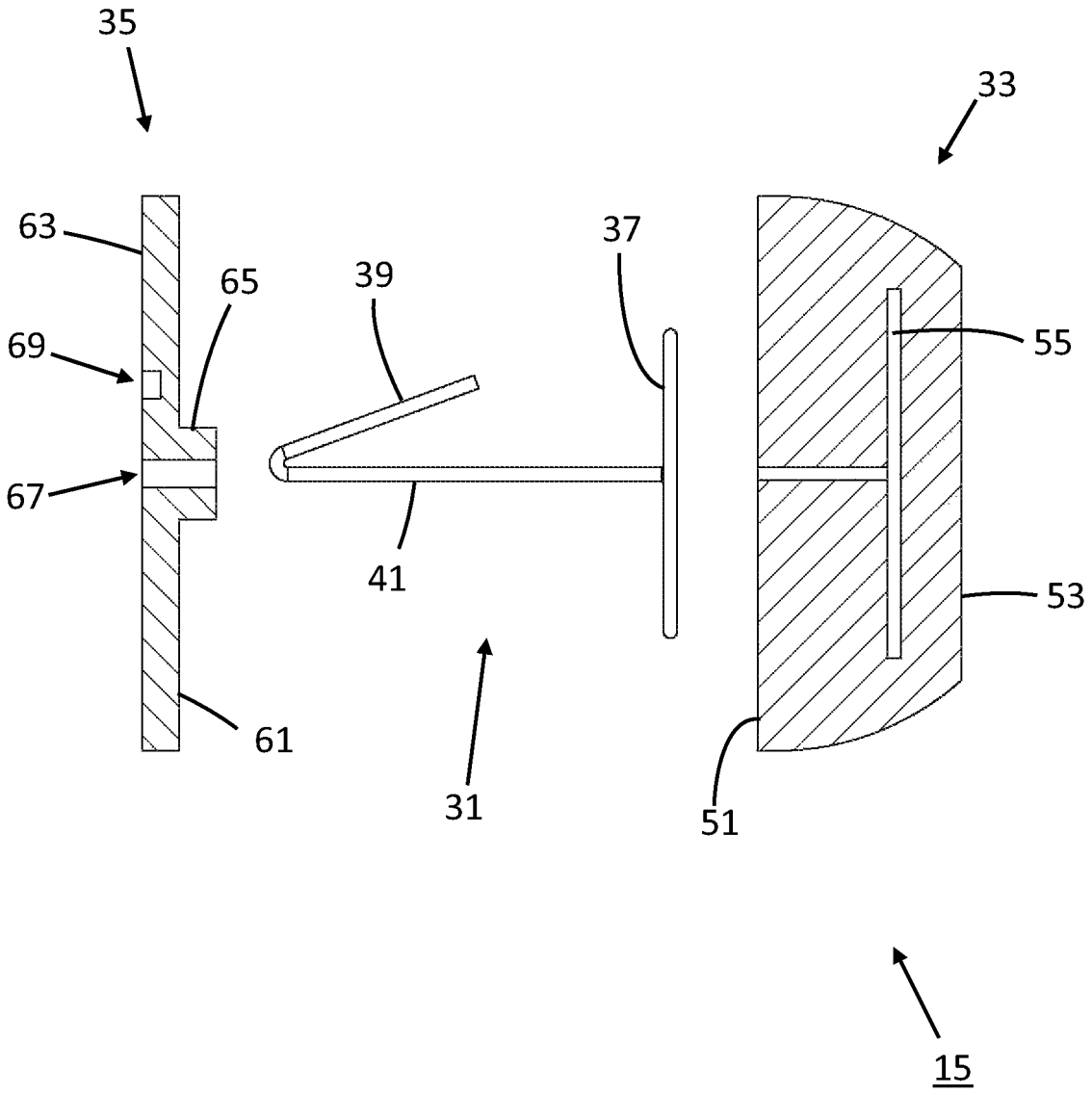
FIG. 4 is an exploded, section view of the antenna assembly shown in FIG. 3, taken along lines 4-4.

As referenced above, antenna assembly 15 is designed to enhance the quality and reliability of wireless communications through an RF-shielded enclosure panel 17 on which it is mounted. Referring now to FIGS. 3 and 4, RF antenna assembly 15 comprises (i) an RF antenna 31 tuned to transmit and receive waves of electromagnetic energy within a defined range in the radio frequency spectrum, (ii) a cap, or dome, 33 mounted over one end of antenna 31, and (iii) a base, or anchor, 35 for receiving the other end of antenna 31. As will be explained in detail below, antenna assembly 15 is designed to be securely mounted on panel 17, with cap 33 and base 35 disposed against opposing panel surfaces and resiliently drawn together by antenna 31.

Antenna 31 is preferably in the form of a continuous length of wire constructed of a suitable conductive material, such as stainless steel, which is bent so as define (i) a circular antenna element 37 at one end, (ii) a linear antenna element 39 at its opposite end, and (iii) a linear intermediate segment 41 which connects elements 37 and 39. As can be seen, circular antenna element 37 lies in a plane generally orthogonal to linear intermediate segment 41. Furthermore, linear antenna element 39 extends at an acute angle relative to intermediate segment 41, thereby creating a spring-like effect which is utilized to retain antenna assembly 15 on panel 17, as will be explained further below.

As can be appreciated, each of antenna elements 37 and 39 is preferably designed to transmit wireless signals in the same, or nearly the same, frequency range within the RF spectrum. In other words, antenna 31 effectively includes two independent antenna elements 37 and 39 that are connected in series by intermediate segment 41. This unique design enables antenna assembly 15 to be through hole mounted on a shielded panel 17 with antenna elements 37 and 39 situated on opposite sides of panel 17. Due to the separate and independent nature of antenna elements 37 and 39, antenna 31 is capable of RF communications on both sides of shielded panel 17 with minimal loss, which is highly desirable. More specifically, antenna element 37, which is located outside of enclosure 13, is designed to wirelessly communicate with exterior devices 19 with minimal attenuation and antenna element 39, which is located within enclosure 13, is designed to wireless communicate with interior devices 21 with minimal attenuation.

As referenced above, each of antenna elements 37 and 39 is tuned to transmit wireless signals in a designated range within the RF spectrum. As can be appreciated, the designated RF range for antenna elements 37 and 39 can be adjusted by simply modifying its shape and/or dimensions. In this manner, antenna 31 can be tuned to a user-selected frequency range by simply bending the continuous wire into different configurations. For instance, if circular antenna element 37 has diameter of 4 cm and produces a passband in the 2.4 GHz spectrum, reconfiguring the wire so that antenna element 37 has a diameter of 2 cm would produce a passband in the 4.8 GHz spectrum. Similar reconfigurations can be readily implemented to produce passbands in other frequency ranges.

Cap, or dome, 33 is a unitary dielectric member which is preferably constructed of a compressible elastomeric material, such as silicone rubber or acrylonitrile butadiene rubber. As will be explained further below, the compressible nature of dome 33 allows for a waterproof seal to be established against shielded panel 17 when drawn with force thereagainst. As a result, sensitive electrical devices 21 are protected from any potentially harmful elements present outside of enclosure 13.

Dome 33 is a solid, generally hemispherical member with a substantially flat inner surface 51 and a substantially flat outer surface 53. Dome 33 is additionally shaped to define an interior groove, or channel, 55 which terminates through the approximate center of inner surface 51. As seen most clearly in FIG. 4, channel 55 matches the general configuration of antenna element 37 as well as a portion of intermediate segment 41. As such, with antenna assembly 15 in its assembled state, channel 55 is dimensioned to fittingly receive antenna element 37 and a portion of intermediate segment 41 therein. Preferably, assembly of antenna 31 and dome 33 is achieved by either mechanically inserting antenna 31 into dome 33 or molding dome 33 around antenna 31. Coupled together in this fashion, cap 33 not only protects antenna element 37 but also helps insulate conductive antenna assembly 15 from metallic panel 17 on which it is mounted.

Base, or anchor, 35 mounts over intermediate segment 41 of antenna 31 and is adapted to receive the distal end of linear antenna element 39. As will be explained further below, base 35 serves as a stud, or anchor, for releasably retaining antenna assembly 15 firmly in place on RF-shielded panel 17.

Base 35 is a solid, generally disc-shaped member with a substantially flat inner surface 61 and a substantially flat outer surface 63. A boss 65, generally circular in lateral cross-section, is integrally formed onto and projects orthogonally out from the center of inner surface 61. As will be explained further in detail below, boss 65 is preferably dimensioned to fittingly project through a corresponding opening, or thru-hole, formed in shielded panel 17.

A transverse bore 67 extends through base 61 in alignment with the approximate center axis of boss 65. Bore 67 is preferably dimensioned to coaxially receive a section of intermediate segment 41 when antenna assembly 15 in its assembled state. An indentation, or notch, 69 is formed in outer surface 63 and extends only a portion of the thickness of base 35. As will be described further below, notch 69 is dimensioned to receive the distal end of linear antenna element 39, thereby preventing antenna element 39 from contacting metal panel 17 as well as enabling antenna 31 to apply a resilient, spring-like force that draws dome 33 and base 35 together for mounting purposes.

Installation of Antenna Assembly 15 onto Panel 17

Figure 5:
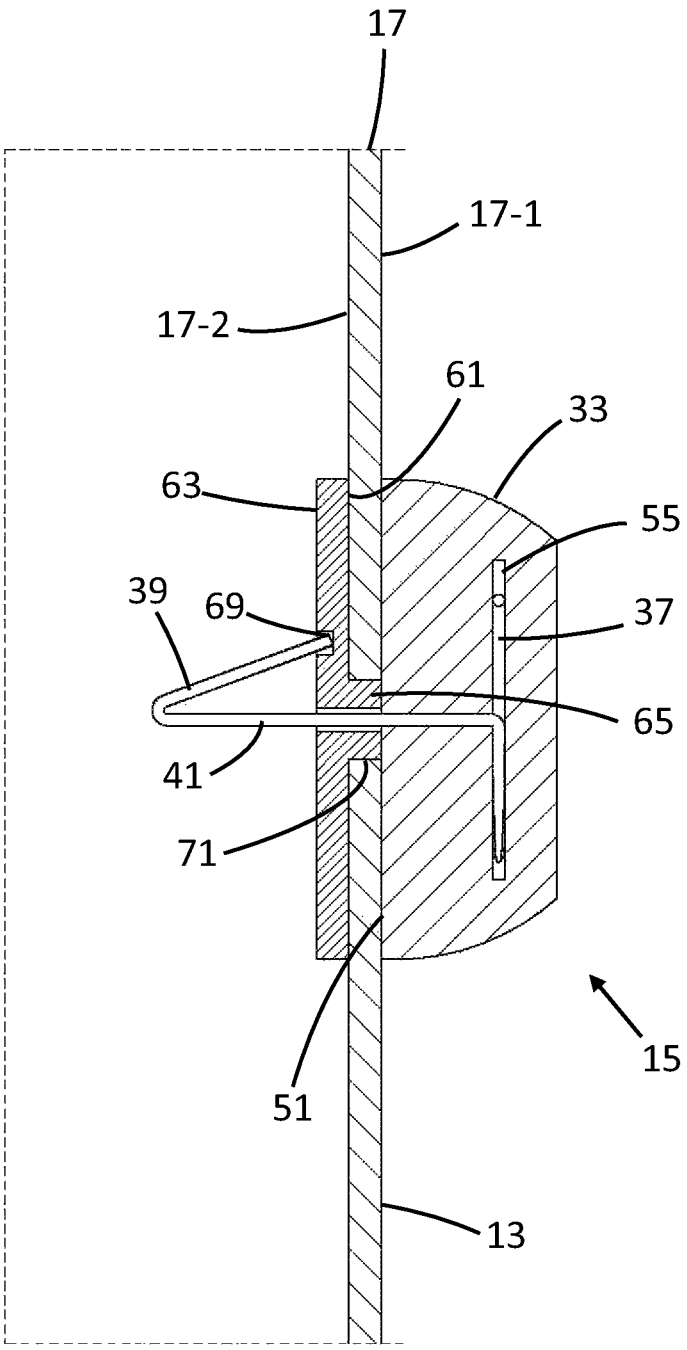
FIG. 5 is a fragmentary, section view of the shielded enclosure and antenna assembly shown in FIG. 2(*b*), taken along lines 5-5.

Referring now to FIG. 5, antenna assembly 15 is preferably installed onto panel 17 of shielded enclosure 13 in the following manner. Preferably, a thru-hole, or opening, 71 is pre-formed in panel 17 to facilitate the mounting of antenna assembly 15 on panel 17.

With circular antenna element 37 fittingly disposed within channel 55, inner surface 51 of dome 33 is disposed flush against outer surface 17-1 of panel 17 such that intermediate segment 41 projects through opening 71 and into the interior of shielded enclosure 13. Anchor 35 is then axially mounted over intermediate segment 41 of antenna 31 and disposed such that boss 65 fittingly protrudes into thru-hole 71 in panel 17. Disposed as such, inner surface 61 of anchor 35 lies flush against interior surface 17-2 of panel 17.

Thereafter, with panel 17 sandwiched firmly between base 35 and cap 33, antenna 31 is bent or otherwise configured such that distal end of linear antenna element 39 projects into notch 69. Bending of antenna 31 creates tension in antenna 31 that resiliently draws together base 35 and cap 33 with such force so as to retain antenna assembly 15 firmly onto panel.

The compressible nature of dome 33 creates a firm watertight seal onto panel 17 around thru-hole 71. As a result, electronic devices 21 retained within enclosure 13 are protected from potentially harmful environmental elements, such as moisture. Additionally, as can be seen, the construction of antenna assembly 15, and in particular dome 33, provides a relatively low profile and, as such, does not significantly increase the overall footprint of enclosure 13.

Actual Test Results Achieved Using Antenna Assembly 15

As referenced above, the unique construction of antenna assembly 15 allows for the transmission of RF signals through an RF-shielded panel with minimal loss. For comparative purposes, RF signals were transmitted through an RF-shielded panel both with and without antenna assembly 15 in order to determine the effectiveness of antenna assembly 15 in facilitating the transmission of RF signals within an RF attenuated environment. The results of the aforementioned testing are detailed below. The following results are provided for illustrative purposes only and are not intended to limit the scope of the present invention.

Figure 6:
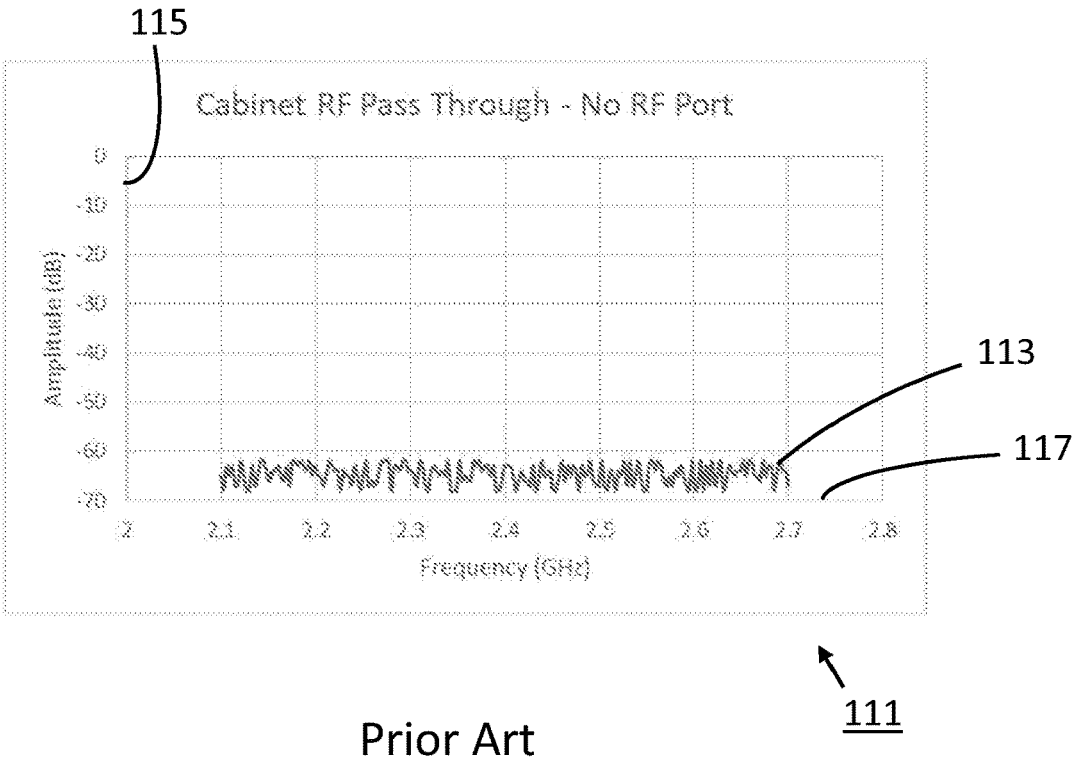
Prior Art Fig. 6
FIG. 6 is a graph of actual measurements of RF signals transmitted through a shielded enclosure in the absence of the antenna assembly shown in FIG. 1, the RF signal being represented in terms of signal strength in relation to signal frequency.
Figure 7:
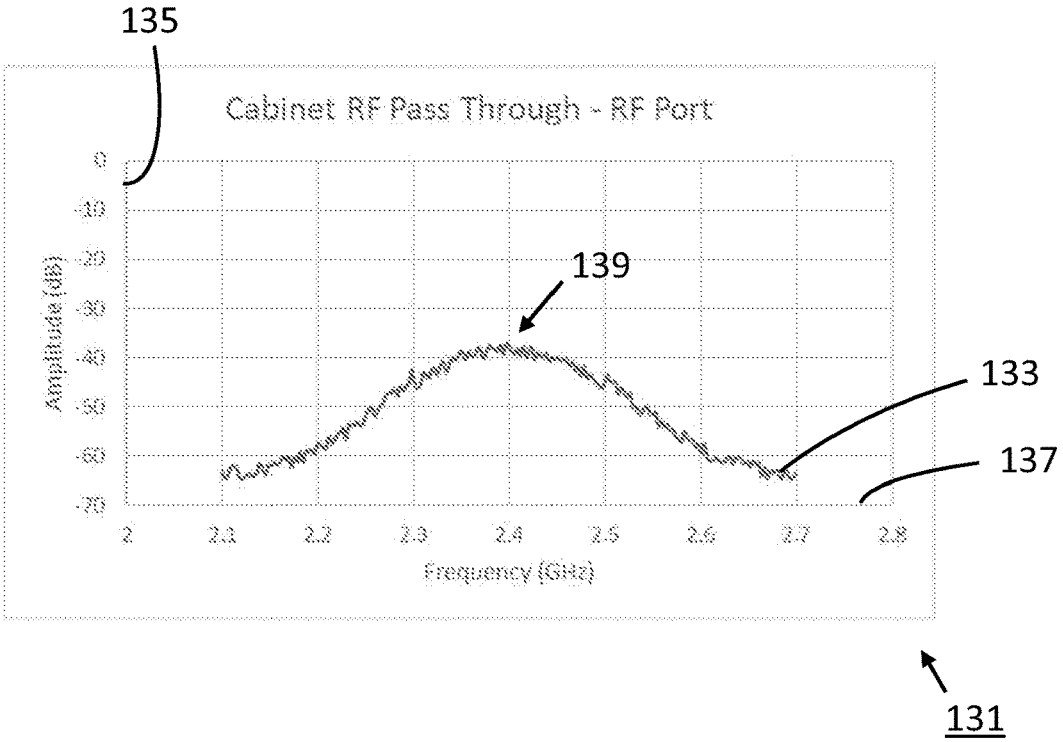
FIG. 7 is a graph of actual measurements of RF signals transmitted through a shielded enclosure using the antenna assembly shown in FIG. 1, the RF signal being represented in terms of signal strength in relation to signal frequency.

FIGS. 6 and 7 are actual graphs which illustrate signal strength relative to signal frequency for a test signal transmitted through an RF-shielded panel. Together, the aforementioned graphs illustrate a notable increase in signal strength that is achieved using antenna assembly 15.

Specifically, in FIG. 6, a graph is shown which illustrates an RF test signal transmitted through an RF-shielded panel in the absence of antenna assembly 15, the comparative graph being identified generally by reference numeral 111. In graph 111, a measured test signal 113 is represented along vertical axis 115 in terms of signal strength, or amplitude, (dB) and along horizontal axis 117 in terms of signal frequency (GHz). In the present example, measured test signal 113 is essentially flat with an amplitude of approximately −65 dB across the frequency spectrum from 2 GHz to 2.8 GHz. These results indicate that an RF signal within the aforementioned frequency spectrum is largely incapable of being effectively transmitted through shielded panel 17. Rather, the constant −65 dB amplitude of test signal 113 can be attributed to the measured noise floor for the system.

By comparison, in FIG. 7, a graph is shown which illustrates an RF test signal transmitted through RF-shielded panel with a test antenna assembly 15 mounted thereon, the graph being identified generally by reference numeral 131. In graph 131, a measured test signal 133 is represented along vertical axis 133 in terms of signal strength, or amplitude, (dB) and along horizontal axis 137 in terms of signal frequency (GHz). As can be seen, the test antenna assembly 15 is specifically tuned to enable a test signal 131 with a frequency passband 139 in the 2.4 GHz spectrum to be transmitted through shielded panel 17. The amplitude of test signal 133 within frequency passband 139 is approximately 25 dB higher than the noise floor. Accordingly, this increase in signal strength would be sufficient for effective RF communications through the shielded panel within frequency passband 139.

Additionally, it should be noted that signals falling outside frequency passband 139 are effectively blocked by antenna assembly 15 from transmission through shielded panel 17. As a result, antenna assembly 15 would serve as a filter other sources of RF energy with a frequency falling outside of passband 139 that could potentially interfere with RF communications within the designated environment.

Additional Embodiments and Design Modifications

The invention described in detail above is intended to be merely exemplary and those skilled in the art shall be able to make numerous variations and modifications to it without departing from the spirit of the present invention. All such variations and modifications are intended to be within the scope of the present invention as defined in the appended claims.

As an example, antenna elements 37 and 39 are not limited to the particular implementations set forth herein. Rather, it is to be understood that each of antenna elements 37 and 39 could be formed in any configuration suitable for the transmission of RF signals (e.g., linear, circular, helical, patch, or the like) without departing from the spirit of the present invention.

Figure 8:
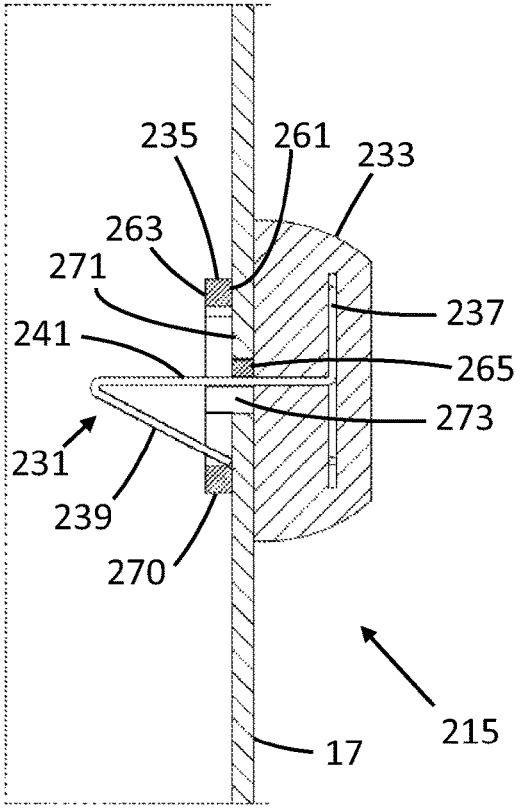
FIG. 8 is a fragmentary, section view of a first modification of the antenna assembly shown in FIG. 5, the modified antenna assembly being constructed according to the teachings of the present invention, the modified antenna assembly being shown mounted on a shielded enclosure and configured in its enabled switching state.

As another example, in FIG. 8, there is shown another embodiment of a panel-mount antenna assembly constructed according to the teachings of the present invention, the antenna assembly being identified generally by reference numeral 215. Antenna assembly 215 is shown mounted on a metal panel 17 with RF-shielding characteristics.

As can be seen, antenna assembly 215 is similar to antenna assembly 15 in that antenna assembly 215 comprises (i) an antenna 231 tuned to transmit and receive waves of electromagnetic energy within a defined range in the radio frequency spectrum, (ii) a cap, or dome, 233 mounted over one end of antenna 231, and (iii) a base, or anchor, 235 for receiving the other end of antenna 231. Furthermore, it should be noted that antenna 231 is similar to antenna 31 in that antenna 231 comprises (i) a circular antenna element 237 at one end, (ii) a linear antenna element 239 at its opposite end, and (iii) an intermediate segment 241 which connects antenna elements 237 and 239 in series.

Antenna assembly 215 differs primarily from antenna assembly 15 in the construction of base 235. As will be explained further below, the unique construction of base 235 provides antenna assembly 215 with switching (i.e., antenna activation/deactivation) capabilities.

Figure 10:
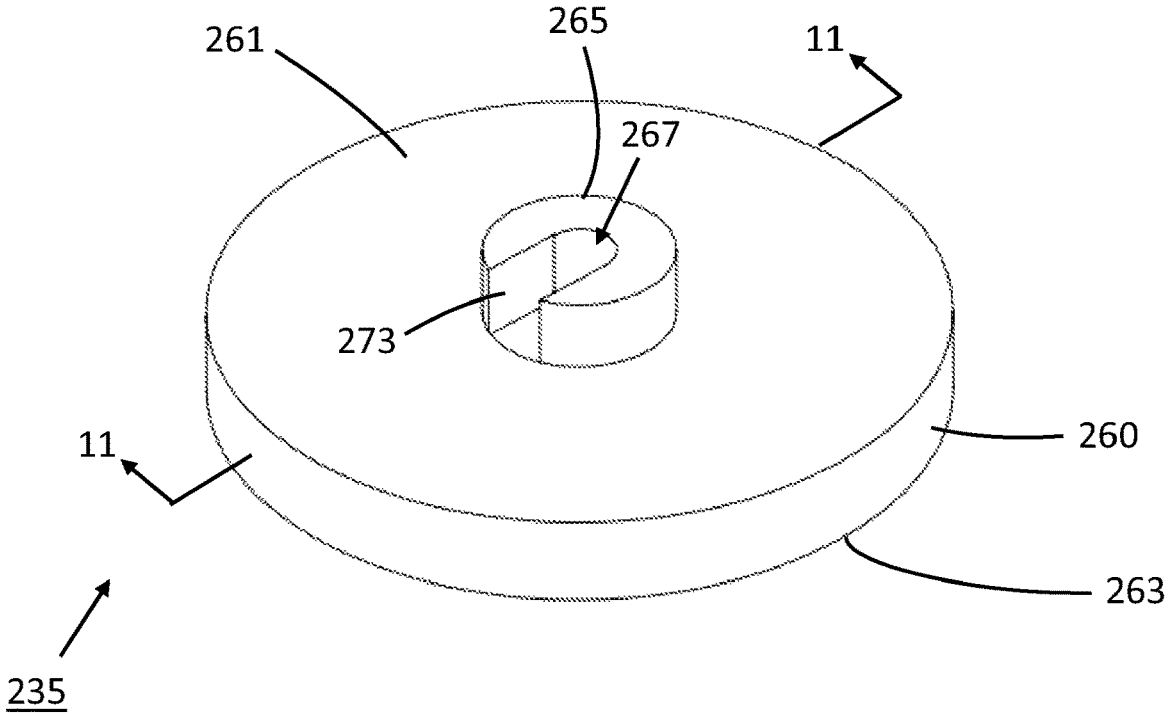
FIG. 10 is a front perspective view of the base of the modified antenna assembly shown in FIG. 8.
Figure 11:
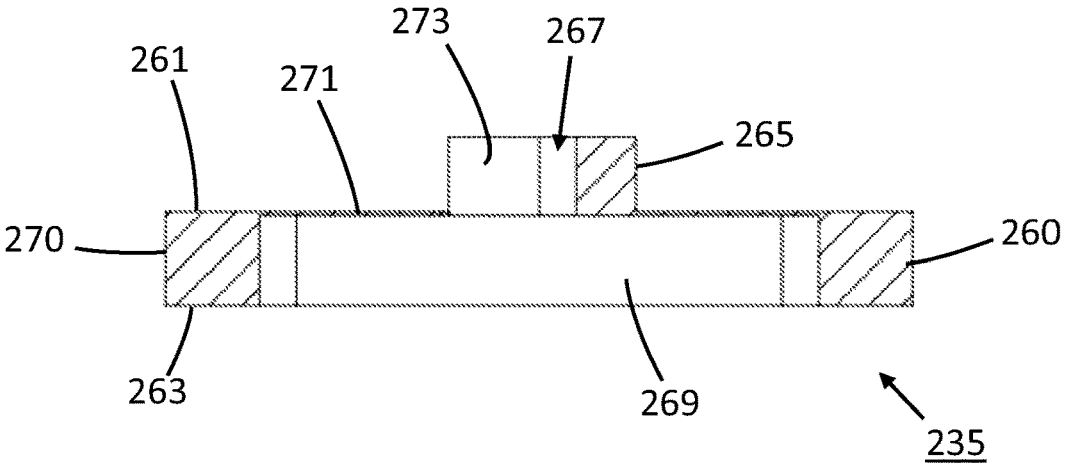
FIG. 11 is a section view of the base shown in FIG. 10, taken along lines 11-11.

As seen most clearly in FIGS. 10 and 11, base 235 is similar to base 35 in that base 235 comprises a generally disc-shaped member 260 with a substantially flat front, or inner, surface 261 and a substantially flat rear, or outer, surface 263. Additionally, a boss 265, generally circular in lateral cross-section, is integrally formed onto and projects orthogonally out from the center of inner surface 261. Furthermore, base 235 is shaped to define a transverse bore 267 in alignment with the approximate center axis of boss 265.

Base 235 differs primarily from base 35 in that disc-shaped member 260 is largely hollowed with a generally annular shape in lateral cross-section. Accordingly, an enlarged interior cavity 269 is formed in disc-shaped member 260 in communication with transverse bore 267. Cavity 269 renders the majority of rear surface 263 open and defines a continuous outer sidewall 270 as well as a thin front wall 271 in the portion of front surface 261 that immediately surrounds boss 265.

Additionally, a radial cutout 273 is formed in boss 265 with a width approximately equal to the diameter of transverse bore 267. As a result, cutout 273 renders bore 267 accessible in one lateral direction. As can be appreciated, the inclusion of front wall 271 and cutout 237 helps provide antenna assembly 215 with its switching capabilities, as will be explained further below.

Referring back to FIG. 8, antenna assembly 215 is shown mounted on panel 17 in its enabled, or activated, switching state. Specifically, with the distal end of linear antenna element 239 angled downward and wedged firmly between sidewall 270 and front wall 271, antenna element 239 creates a spring-like force which resiliently urges intermediate segment 241 upward and into contact with boss 265. Because base 235 prevents antenna element 239 from directly contacting any portion of metal panel 17, antenna 231 enabled to actively send and receive RF signals. More particularly, antenna element 237 is capable of wireless communications with RF devices located outside of panel 17 and antenna element 239 is capable of wireless communications with RF devices located inside of panel 17.

Figure 9:
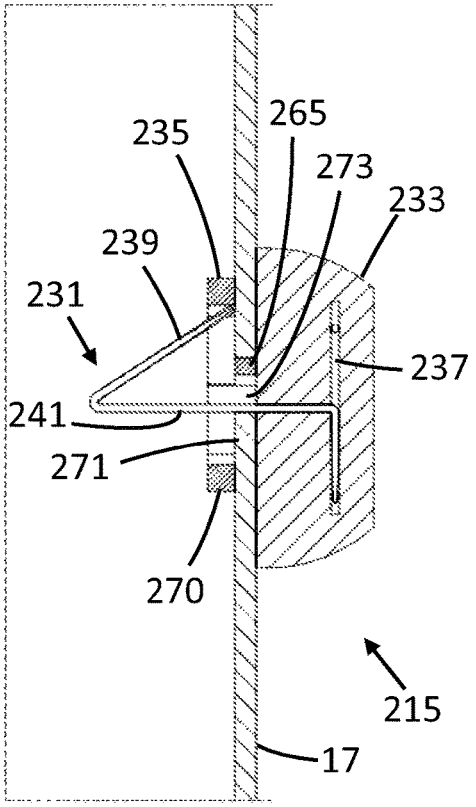
FIG. 9 is a fragmentary, section view of the modified antenna assembly shown in FIG. 8, the modified antenna assembly being shown mounted on a shielded enclosure and configured in its disabled switching state.

However, in FIG. 9, antenna assembly 215 is shown mounted on panel 17 in its disabled, or deactivated, switching state. By simply rotating dome 233 and antenna 241 approximately 180 degrees, the distal end of linear antenna element 239 is repositioned in an upward orientation and is wedged firmly between sidewall 270 and front wall 271, as shown. Configured as such, antenna element 239 creates a spring-like force which resiliently urges intermediate segment 241 downward through cutout 273 in boss 265 and into direct contact with metal panel 17. The establishment of direct contact with metal panel 17 effectively shorts (i.e., disables) antenna 231 and thereby precludes antenna 213 from sending and/or receiving RF signals.

Accordingly, in a simple and convenient fashion, antenna assembly 215 can be switched between enabled and disabled operational states. As a feature of the invention, switching of the operational state of antenna assembly 215 can only be accomplished with access to the interior of panel 17, thereby minimizing any risk of tampering. Additionally, it should be noted that the aforementioned construction allows for switching of the operational state of antenna assembly 215 without requiring incorporation of designated electrical switching components, such as switches, inductors, capacitors, filters, and the like, which would otherwise increase manufacturing costs and introduce significant mechanical complexities.

It is to be understood that additional variations of a panel-mount antenna assembly designed with switching capabilities could be implemented without departing from the present invention. For instance, in FIG. 12, there is shown another embodiment of a panel-mount antenna assembly constructed according to the teachings of the present invention, the antenna assembly being identified generally by reference numeral 315. Antenna assembly 315 is shown mounted on a panel 317 of a metal enclosure 318 with RF-shielding characteristics.

As can be seen, antenna assembly 315 is similar to antenna assembly 15 in that antenna assembly 315 comprises (i) an antenna 331 tuned to transmit and receive waves of electromagnetic energy within a defined range in the radio frequency spectrum, and (ii) a base, or anchor, 335 fixedly mounted on panel 17 and adapted to retain antenna 331.

Antenna assembly 315 differs primarily from antenna assembly 15 in the construction of antenna 331. Specifically, antenna 331 comprises a substantially straight length of conductive wire 336 which includes a first end 337 situated within the interior of enclosure 318 and a second end 339 situated outside of enclosure 318. Antenna 331 additionally includes (i) a first bulbous enlargement, or stop, 341 formed on second end 339 of wire 336, and (ii) a second bulbous enlargement, or stop, 343 formed on wire 336 at the approximate midpoint between first end 337 and second end 339. As can be appreciated, stop 343 serves to partition, or divide, wire 336 into (i) a first, or interior, segment 345 between stop 343 and first end 337, and (ii) a second, or exterior, segment 347 between stop 343 and second end 339.

As a feature of the invention, wire 336 is adapted for axial displacement relative to base 335 (and panel 317). As will be explained further below, the ability to axially displace wire 336 provides antenna assembly 315 with its switching (i.e., antenna activation/deactivation) capabilities.

Figure 12:
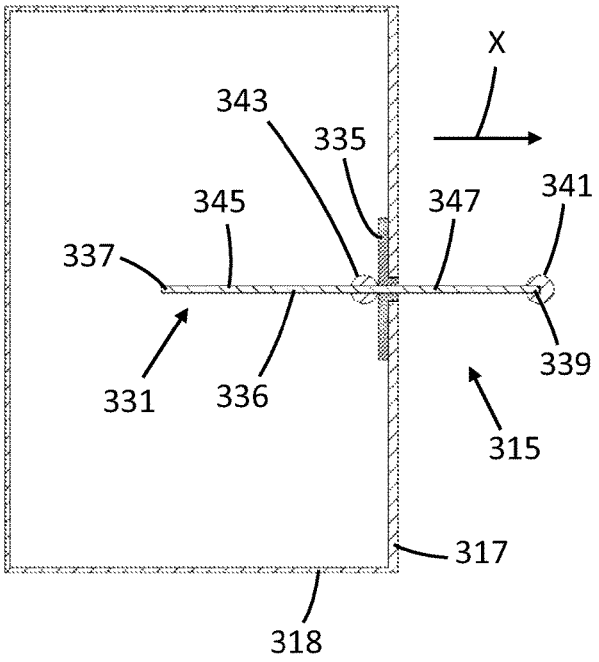
FIG. 12 is a fragmentary, section view of a second modification of the antenna assembly shown in FIG. 5, the modified antenna assembly being constructed according to the teachings of the present invention, the modified antenna assembly being shown mounted on a shielded enclosure and configured in its enabled switching state.

Specifically, in FIG. 12, antenna assembly 315 is shown mounted on panel 317 in its enabled, or activated, switching state. Notably, wire 336 is pulled axially outward, as represented by arrow X, until stop 343 abuts base 335. Disposed as such, the majority of exterior segment 347 is disposed outside of enclosure 318 and is of a suitable length to effectively transmit and receive electromagnetic energy.

Figure 13:
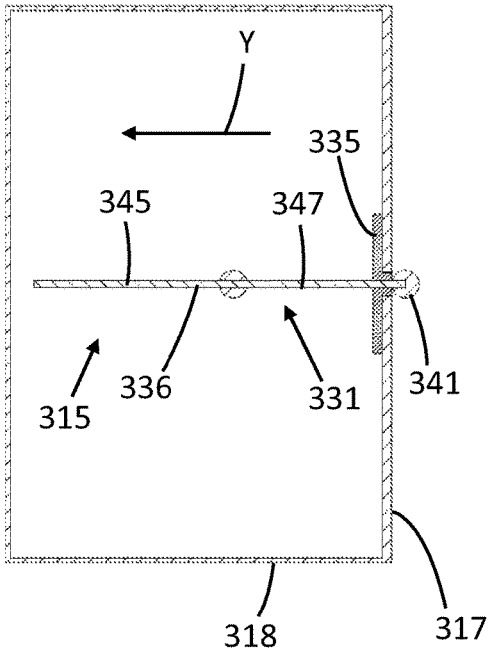
FIG. 13 is a fragmentary, section view of the modified antenna assembly shown in FIG. 12, the modified antenna assembly being shown mounted on a shielded enclosure and configured in its disabled switching state.

By contrast, in FIG. 13, antenna assembly 315 is shown mounted on panel 317 in its disabled, or deactivated, switching state. Notably, wire 336 is pushed axially inward, as represented by arrow Y, until stop 341 abuts base 335. Disposed as such, the majority of exterior segment 347 is disposed inside of enclosure 318. As a result, the length of wire 336 remaining outside of enclosure 318 is insufficient to effectively transmit and receive electromagnetic energy. In other words, rather than rely on shorting antenna 331 to achieve disablement, antenna assembly 315 simply adjusts the length of wire 336 that extends outside of enclosure 318 to modify its transmissive properties.

What is claimed is:

1. A radio frequency (RF) antenna assembly adapted to be mounted on a shielded panel, the shielded panel having a first surface and a second surface, the shielded panel being shaped to define a thru-hole, the RF antenna assembly comprising:

(a) an RF antenna constructed from a continuous length of metal wire, the RF antenna comprising,
  (i) a first antenna element tuned to transmit and receive electromagnetic signals within a first frequency range in the RF spectrum,
  (ii) a second antenna element tuned to transmit and receive electromagnetic signals within a second frequency range in the RF spectrum, and
  (iii) an intermediate segment connecting the first and second antenna elements in series;

(b) a cap mounted over the first antenna element; and (c) a base mounted on the RF antenna, the base being configured to receive at least a portion of the second antenna element;

(d) wherein the RF antenna assembly is adapted to be mounted on the shielded panel with the first and second antenna elements disposed on opposite surfaces of the shielded panel and at least a portion of the cap and at least a portion of the base disposed on opposite surfaces of the shielded panel, wherein the RF antenna imparts a spring force that resiliently draws the cap and the base towards one another;

(e) wherein each of the cap and the base is constructed of a dielectric material, the cap and the base being adapted to selectively insulate the RF antenna from conductive contact with the shielded panel.

2. The RF antenna assembly as claimed in claim 1 wherein the continuous length of metal wire is bent to define the first and second antenna elements.

3. The RF antenna assembly as claimed in claim 2 wherein the first frequency range in which the first antenna element is tuned to transmit and receive electromagnetic energy can be adjusted by reconfiguring the first antenna element.

4. The RF antenna assembly as claimed in claim 3 wherein the second frequency range in which the second antenna element is tuned to transmit and receive electromagnetic energy can be adjusted by reconfiguring the second antenna element.

5. The RF antenna assembly as claimed in claim 4 wherein the first antenna element has a circular configuration.

6. The RF antenna assembly as claimed in claim 5 wherein the second antenna element has a linear configuration.

7. A radio frequency (RF) antenna assembly adapted to be mounted on a shielded panel, the shielded panel having a first surface and a second surface, the shielded panel being shaped to define a thru-hole, the RF antenna assembly comprising:

(a) an RF antenna comprising,
  (i) a first antenna element tuned to transmit and receive electromagnetic signals within a first frequency range in the RF spectrum,
  (ii) a second antenna element tuned to transmit and receive electromagnetic signals within a second frequency range in the RF spectrum, and
  (iii) an intermediate segment connecting the first and second antenna elements in series;

(b) a cap mounted over the first antenna element, the cap being constructed of a compressible elastomeric material, wherein the cap is a solid, generally hemispherical member with a substantially flat inner surface and a substantially flat outer surface; and (c) a base mounted on the RF antenna, the base being configured to receive at least a portion of the second antenna element;

(d) wherein the RF antenna assembly is adapted to be mounted on the shielded panel with the first and second antenna elements disposed on opposite surfaces of the shielded panel and at least a portion of the cap and at least a portion of the base disposed on opposite surfaces of the shielded panel, wherein the RF antenna imparts a spring force that resiliently draws the cap and the base towards one another;

(e) wherein each of the cap and the base is constructed of a dielectric material, the cap and the base being adapted to selectively insulate the RF antenna from conductive contact with the shielded panel.

8. The RF antenna assembly as claimed in claim 7 wherein the cap is shaped to define an interior groove which terminates through the inner surface, the interior groove being dimensioned to fittingly receive at least a portion of the first antenna element.

9. A radio frequency (RF) antenna assembly adapted to be mounted on a shielded panel, the shielded panel having a first surface and a second surface, the shielded panel being shaped to define a thru-hole, the RF antenna assembly comprising:

(a) an RF antenna comprising, (i) a first antenna element tuned to transmit and receive electromagnetic signals within a first frequency range in the RF spectrum, (ii) a second antenna element tuned to transmit and receive electromagnetic signals within a second frequency range in the RF spectrum, and (iii) an intermediate segment connecting the first and second antenna elements in series;

(b) a cap mounted over the first antenna element; and (c) a base mounted on the RF antenna, the base being configured to receive at least a portion of the second antenna element, wherein the base is a solid, disc-shaped member that includes a flat inner surface and a flat outer surface, wherein the base comprises a bass that is formed onto and projects orthogonally out from the inner surface, the boss being adapted to fittingly protrude through the thru-hole in the shielded panel;

(d) wherein the RF antenna assembly is adapted to be mounted on the shielded panel with the first and second antenna elements disposed on opposite surfaces of the shielded panel and at least a portion of the cap and at least a portion of the base disposed on opposite surfaces of the shielded panel, wherein the RF antenna imparts a spring force that resiliently draws the cap and the base towards one another;

(e) wherein each of the cap and the base is constructed of a dielectric material, the cap and the base being adapted to selectively insulate the RF antenna from conductive contact with the shielded panel.

10. The RF antenna assembly as claimed in claim 9 wherein a transverse bore extends through the base in alignment with the boss, the transverse bore being dimensioned to fittingly receive at least a portion of the intermediate segment of the antenna.

11. The RF antenna assembly as claimed in claim 10 wherein a notch is formed in the outer surface of the base and is dimensioned to receive a distal end of the second antenna element.

12. The RF antenna assembly as claimed in claim 11 wherein a thru-hole is formed in the base spaced away from the boss and the notch, the thru-hole extending from the inner surface to the outer surface, the thru-hole being dimensioned to enable the second antenna element to project therethrough.

13. The RF antenna assembly as claimed in claim 10 wherein a radial cutout is formed in the boss, the cutout being dimensioned to enable a portion of the intermediate segment to selectively project therethrough.

* * * * *